US009368254B2

(12) United States Patent
Shanai et al.

(10) Patent No.: US 9,368,254 B2
(45) Date of Patent: Jun. 14, 2016

(54) ADHESIVE RESIN COMPOSITION, ADHESIVE FILM USING THE SAME AND FLAT CABLE

(71) Applicant: Hitachi Metals, Ltd., Tokyo (JP)

(72) Inventors: Daisuke Shanai, Hitachi (JP); Tomiya Abe, Yoshikawa (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 14/098,684

(22) Filed: Dec. 6, 2013

(65) Prior Publication Data

US 2014/0158398 A1 Jun. 12, 2014

(30) Foreign Application Priority Data

Dec. 10, 2012 (JP) ..... 2012-269243

(51) Int. Cl.
*H01B 3/42* (2006.01)
*H01B 7/08* (2006.01)

(52) U.S. Cl.
CPC ..... *H01B 3/421* (2013.01); *H01B 3/427* (2013.01); *Y10T 428/2852* (2015.01)

(58) Field of Classification Search
CPC ... H01B 3/421; H01B 3/427; Y10T 428/2852
USPC ..... 174/117 A
See application file for complete search history.

(56) References Cited

U.S. PATENT DOCUMENTS 6,201,067 B1 * 3/2001 Cheung ..... C08L 23/08 525/132
2007/0106054 A1 * 5/2007 Crawford ..... C08G 63/199 528/272
2011/0040038 A1 * 2/2011 Arai ..... C08F 210/02 525/185
2012/0037410 A1 * 2/2012 Amou ..... B32B 7/02 174/258
2013/0020118 A1 * 1/2013 Ito ..... C08G 18/6659 174/259

FOREIGN PATENT DOCUMENTS

JP 63-089656 4/1988
JP H04178413 A 6/1992
JP 2011-222371 11/2011

OTHER PUBLICATIONS

Japanese Office Action dated Dec. 2, 2014 and English translation of notice of reasons for rejection.

* cited by examiner

*Primary Examiner* — Timothy Thompson
*Assistant Examiner* — Paul McGee, III
(74) *Attorney, Agent, or Firm* — Roberts Mlotkowski Safran & Cole, PC

(57) ABSTRACT

An adhesive resin composition includes 60 to 95 parts by mass of amorphous thermoplastic polyester-based resin (A), 5 to 40 parts by mass of polyphenylene ether-based polymer (B) including a hydroxyl group and a repeating unit of 2,6-dimethylphenylene ether in a molecule thereof, and 60 to 200 parts by mass of a flame retardant per total 100 parts by mass of the amorphous thermoplastic polyester based resin (A) and the polyphenylene ether-based polymer (B).

10 Claims, 2 Drawing Sheets

ADHESIVE RESIN COMPOSITION, ADHESIVE FILM USING THE SAME AND FLAT CABLE

The present application is based on Japanese patent application No. 2012-269243 filed on Dec. 10, 2012, the entire contents of which are incorporated herein by reference.

BACKGROUND OF THE INVENTION

1. Field of the Invention

The invention relates to an adhesive resin composition, an adhesive film using the adhesive resin composition and a flat cable using the adhesive film.

2. Description of the Related Art

Flat cable is a cable composed of plural rectangular conductors arranged in parallel and two adhesive films sandwiching and covering thereof, and has characteristics of small in thickness and excellent in flexibility. Such flat cable are widely used as an internal wiring cable for office automation equipments such as printers and scanners, computer devices, video equipments such as flat-screen TVs, audio equipments, robots, various electric and electronic equipments such as ultrasonic diagnostic equipments and vehicles. Especially in case of using as an internal wiring material of electronic equipments, it is necessary to meet the UL standard and high flame retardancy is required. Also in an automotive application, flame retardancy is often required.

The adhesive film covering the plural rectangular conductors in the flat cable is often formed by wet-coating a base film with an adhesive dissolved in a solvent. Engineering plastic films excellent in heat resistance and chemical resistance are used for such a base film. Among others, polyethylene terephthalate (PET) films widely available in market and excellent in cost or supply stability are particularly preferably used.

In order to improve adhesion between a PET film and an adhesive, a surface of the polyethylene terephthalate film to which the adhesive is applied is corona-treated or UV-treated.

Meanwhile, methods of imparting flame retardancy to the flat cable include a method of rendering an insulating film itself flame-retardant and a method of rendering an adhesive flame-retardant.

One of the methods of rendering the insulating film itself flame-retardant is to use a film made of a self-extinguishing resin such as polyimide. However, films formed of a self-extinguishing resin as described above are very expensive and are only used for special purposes. Therefore, in many cases, flame retardancy is imparted by adding a flame retardant to an adhesive.

As a base of a resin for forming an adhesive layer (an adhesive layer-forming resin), thermoplastic polyester-based resins having good adhesion especially to polyethylene terephthalate used as a base material are widely used. Such thermoplastic polyester-based resins are categorized into amorphous and crystalline resins. Amorphous thermoplastic polyester-based resins are well dissolved in general organic solvents such as toluene or methyl ethyl ketone and are thus widely used as an adhesive layer-forming resin of general-purpose flat cable.

Thermoplastic polyester-based resins having high adhesion, especially amorphous thermoplastic polyester-based resins, have low heat resistance due to glass transition temperature as low as room temperature or less and is sometimes used after crosslinked with an isocyanate compound since it is difficult to use as-is for heat-resistant purpose. However, there is a problem that it is difficult to control degree of crosslinking due to high reactivity of isocyanate.

Therefore, a resin having a high glass transition temperature is blended in order to enhance heat resistance in a stable manner.

Meanwhile, crystalline thermoplastic polyester-based resins have good heat resistance and are applicable as an adhesive layer-forming resin of heat-resistant flat cable. Resin compositions formed using crystalline thermoplastic polyester-based resin such as polyethylene terephthalate (PET) or polybutylene terephthalate (PBT) have been proposed in order to improve heat resistance (see, e.g., JP-A-H04-178413).

SUMMARY OF THE INVENTION

However, in case of blending a resin having high glass transition temperature, there is a restriction that the resin to be blended needs to be soluble in the same solvent as the thermoplastic polyester-based resin is. Although, a thermoplastic polyester-based resin having a glass transition temperature of more than 40° C. may be used as the resin having high glass transition temperature, there is a problem that it is still not possible to impart sufficient heat resistance since the glass transition temperature of the amorphous thermoplastic polyester-based resin is at most about 90° C.

On the other hand, the crystalline thermoplastic polyester-based resin as typified by the resin composition described in JP-A-H04-178413 tends not to be dissolved in a solvent due to its crystallinity and is thus hardly dissolved in general-purpose organic solvents. It is therefore considered that a method of forming a coating material by dissolving such a resin composition in a chlorinated organic solvent such as methylene chloride followed by wet-coating thereof to form an adhesive layer could be used but there is a problem that the chlorinated organic solvent raises concerns about adverse effects on human body and environment and use thereof should be avoided.

Other than the above, a method of extruding a thin film by an extruder has been considered to allow use of the crystalline thermoplastic polyester-based resin. This method has a problem that large-scale equipment is required and the manufacturing cost is higher than wet-coating. In addition, in case that a large amount of flame retardant is contained in an adhesive, there is a problem that it is very difficult to extrude a uniformly thin film. Furthermore, the thermoplastic polyester-based resin has a problem that it is generally likely to absorb moisture and dielectric properties are thus poor.

It is an object of the invention to provide an adhesive resin composition that satisfies all of heat resistance, flame retardancy, adhesion and dielectric properties without using any chlorinated organic solvent while using a general-purpose organic solvent and using an amorphous thermoplastic polyester-based resin as a base, as well as an adhesive film using the adhesive resin composition and a flat cable using the adhesive film.

(1) According to one embodiment of the invention, an adhesive resin composition comprises:

60 to 95 parts by mass of amorphous thermoplastic polyester-based resin (A);

5 to 40 parts by mass of polyphenylene ether-based polymer (B) comprising a hydroxyl group and a repeating unit of 2,6-dimethylphenylene ether in a molecule thereof; and 60 to 200 parts by mass of a flame retardant per total 100 parts by mass of the amorphous thermoplastic polyester based resin (A) and the polyphenylene ether-based polymer (B).

In the above embodiment (1) of the invention, the following modifications and changes can be made.

(i) The adhesive resin composition further comprises 1 to 15 parts by mass of an isocyanate compound (C) per total 100 parts by mass of the amorphous thermoplastic polyester based resin (A) and the polyphenylene ether-based polymer (B), wherein the isocyanate compound (C) comprises a plurality of isocyanate groups in a molecular structure thereof.

(ii) The amorphous thermoplastic polyester based resin (A) has a glass transition temperature of −20 to 40° C.

(iii) The polyphenylene ether-based polymer (B) has an average molecular weight of 1000 to 3000 in terms of styrene.

(iv) The flame retardant comprises at least one of bromine compounds, phosphorus compounds, nitrogen compounds and metal compounds.

(2) According to another embodiment of the invention, an adhesive film comprises:

a base film; and an adhesive layer that comprises the adhesive resin composition according to the above embodiment (1) and is formed on the base film by wet-coating.

(3) According to another embodiment of the invention, a flat cable comprises:

a pair of the adhesive films according to the above embodiment (2) arranged so that the respective adhesive layers face each other; and a plurality of conductors sandwiched between the pair of the adhesive films and arranged in parallel to each other, wherein the pair of the adhesive films are adhered to and integrated with the conductors by adhesion between the respective adhesive layers of the pair of the adhesive films.

Effects of the Invention

According to one embodiment of the invention, an adhesive resin composition can be provided that satisfies all of heat resistance, flame retardancy, adhesion and dielectric properties without using any chlorinated organic solvent while using a general-purpose organic solvent and using an amorphous thermoplastic polyester-based resin as a base, as well as an adhesive film using the adhesive resin composition and a flat cable using the adhesive film.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Summary of the Embodiment

Figure 1:
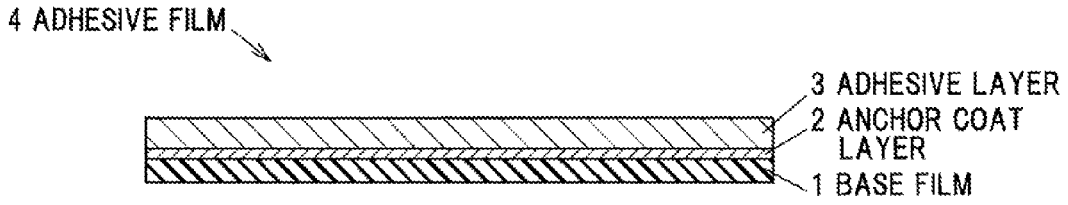
FIG. 1 is a schematic cross sectional view showing an adhesive film in an embodiment of the present invention.

An adhesive resin composition in the present embodiment uses a thermoplastic polyester-based resin as a base resin and comprises 60 to 95 parts by mass of amorphous thermoplastic polyester-based resin (A), 5 to 40 parts by mass of polyphenylene ether-based polymer (B) comprising a hydroxyl group and a repeating unit of 2,6-dimethylphenylene ether in a molecule thereof, and 60 to 200 parts by mass of a flame retardant per total 100 parts by mass of the amorphous thermoplastic polyester based resin (A) and the polyphenylene ether-based polymer (B).

Meanwhile, an adhesive film in the present embodiment has a base film and an adhesive layer. The adhesive layer contains the above-mentioned adhesive resin composition and is formed on the base film by wet-coating.

In addition, a flat cable in the present embodiment has a pair of the adhesive films and plural conductors sandwiched between the pair of the adhesive films, and is configured that the pair of adhesive films are arranged so that the respective adhesive layers face each other, the plural conductors are sandwiched between the pair of adhesive films and are arranged in parallel to each other, and the pair of the adhesive films are adhered to and integrated with the conductors by adhesion between the respective adhesive layers of the pair of the adhesive films.

1. Adhesive Resin Composition

As described above, the adhesive resin composition in the present embodiment comprises 60 to 95 parts by mass of amorphous thermoplastic polyester-based resin (A), 5 to 40 parts by mass of polyphenylene ether-based polymer (B) comprising a hydroxyl group and a repeating unit of 2,6-dimethylphenylene ether in a molecule thereof, and 60 to 200 parts by mass of a flame retardant per total 100 parts by mass of the amorphous thermoplastic polyester based resin (A) and the polyphenylene ether-based polymer (B).

1-1. Amorphous Thermoplastic Polyester-Based Resin (A)

In the present embodiment, an amorphous thermoplastic polyester-based resin (A) which has good adhesion to a based film formed of any type of engineering plastic is used as a base resin constituting the adhesive resin composition.

The amorphous thermoplastic polyester-based resin (A) is well dissolved in various general-purpose solvents and is very well dissolved especially in toluene and methyl ethyl ketone. It is preferable to have a glass transition temperature of −20 to 40° C. In case of less than −20° C., blocking (a phenomenon in which one surface sticks to another surface at the time of laminating or rolling a film) may occur or strength may not be enough when used for the adhesive film. In case of more than 40° C., adhesion may be insufficient or flexibility may be impaired.

As the amorphous thermoplastic polyester-based resin (A), it is possible to use, e.g., product name: Vylon (registered trademark) manufactured by Toyobo Co., Ltd. or product name: Elite1 (registered trademark) manufactured by Unitika Ltd., etc.

1-2. Polyphenylene Ether-Based Polymer (B)

A resin blended with the base resin (the amorphous thermoplastic polyester-based resin (A)) needs to be dissolved in toluene and methyl ethyl ketone so as to be formed, together with the amorphous thermoplastic polyester-based resin, into a coating material. In addition, high glass transition temperature is required in order to impart heat resistance which cannot be achieved by the amorphous thermoplastic polyester-based resin (A). A resin having a glass transition temperature of more than 100° C. is preferable.

It is further required to have a hydroxyl group, as a functional group reactive with an isocyanate compound, in a molecule and it is preferable to contain an amino group, etc., in addition to the hydroxyl group. Such resins include the polyphenylene ether-based polymer (B) having 2,6-dimethylphenylene ether as a repeating unit. The polyphenylene ether-based polymer (B) is excellent in heat resistance and dielectric properties, hence, blending the polyphenylene ether-based polymer (B) with the amorphous thermoplastic polyester-based resin (A) allows dielectric properties to be improved and heat resistance to be increased.

It is preferable that the polyphenylene ether-based polymer (B) have low molecular weight. It is because the polyphenylene ether-based polymer having low molecular weight is more likely to be dissolved in a general-purpose solvent such as toluene than that having high molecular weight. In more detail, it is preferable to have an average molecular weight of 1000 to 3000 in terms of styrene. When the molecular weight is more than 3000, softening temperature is high and hot melt becomes difficult, which may lead to a decrease in adhesive strength. When the molecular weight is less than 1000, the softening temperature is low and it may not possible to impart heat resistance.

Among such polyphenylene ether-based polymers (B), for example, a low molecular weight polyphenylene ether (product name: OPE (registered trademark) manufactured by Mitsubishi Gas Chemical Company, Inc.) can be use as a polyphenylene ether-based polymer having hydroxyl groups at both terminals.

The amorphous thermoplastic polyester-based resin (A) and the polyphenylene ether-based polymer (B) having hydroxyl groups in a molecule (especially at both terminals) are soluble in a solvent and thus can be applied by wet-coating to form a uniformly thin film. A blend ratio of the amorphous thermoplastic polyester-based resin (A) to the polyphenylene ether-based polymer (B) having hydroxyl groups at both terminals is 60 to 95 parts by mass of the amorphous thermoplastic polyester-based resin (A) to 5 to 40 parts by mass of the polyphenylene ether-based polymer (B) having hydroxyl groups at both terminals. When the polyphenylene ether-based polymer is less than 5 parts by mass, it is not possible to impart sufficient heat resistance. When the polyphenylene ether-based polymer is more than 40 parts by mass, adhesive strength is insufficient.

1-3. Flame Retardant

The adhesive resin composition in the present embodiment contains a flame retardant. One or more compounds selected from the group consisting of bromine compounds, phosphorus compounds, nitrogen compounds and metal compounds can be used as the flame retardant.

Examples of the bromine compounds include ethylenebis (pentabromophenyl), ethylenebis(tetrabromophthalimide) and tetrabromobisphenol A, etc.

Examples of the phosphorus compounds include metal phosphate, phosphate, melamine polyphosphate, ammonium polyphosphate, phosphate ester, condensed phosphate ester and phosphazene compound.

Examples of the nitrogen compounds include melamine sulfate, guanidine compound, melamine compound and 1,3,5-triazine derivative.

Examples of the metal compounds include magnesium hydroxide, aluminium hydroxide, zinc stannate, zinc hydroxystannate, zinc borate, calcium borate, zinc sulfide and antimony trioxide.

The above-mentioned flame retardants may be used alone or as a mixture of two or more compounds.

In addition, the flame retardant can be contained in an amount of 60 to 200 parts by mass per 100 parts by mass of the resin portion (the amorphous thermoplastic polyester-based resin (A)+the polyphenylene ether-based polymer (B)). It is not possible to impart sufficient flame retardancy when less than 60 parts by mass while adhesive strength is impaired when more than 200 parts by mass.

1-4. Isocyanate Compound (C)

In the present embodiment, an isocyanate compound (C) having plural isocyanate groups in the structure thereof is preferably used together, if necessary, with a blend of the amorphous thermoplastic polyester-based resin (A) and the polyphenylene ether-based polymer (B) having hydroxyl groups at both terminals. The isocyanate group reacts with the hydroxyl group in the amorphous thermoplastic polyester-based resin (A) or the hydroxyl groups at the both terminals of the polyphenylene ether-based polymer (B) and forms a urethane linkage. This increases molecular weight and it is thus possible to contribute to improvement in heat resistance. In addition, when directly applying to the base film, the isocyanate group also reacts with a functional group containing active hydrogen, such as hydroxyl group or amino group, in the engineering plastic constituting the base film and it is thus possible to contribute to improvement in adhesive strength. Any compounds can contribute to improvement in adhesive strength as long as plural isocyanate groups are contained.

Specific examples thereof include hexamethylene diisocyanate and poly(hexamethylene diisocyanate) as a polymer thereof, dicyclohexylmethane-4,4'-diisocyanate, 1,5-naphthalene diisocyanate, 2,4-tolylene diisocyanate and poly(2,4-tolylene diisocyanate) as a polymer thereof, trimethyl hexamethylene diisocyanate, isophorone diisocyanate and m-xylene diisocyanate, etc.

It is preferable to add these isocyanate compounds in an amount of 1 to 15 parts by mass per 100 parts by mass of the resin portion (the amorphous thermoplastic polyester-based resin (A)+the polyphenylene ether-based polymer (B)). It may not be possible to contribute to improvement in adhesive strength when less than 1 part by mass. Excessive curing occurs resulting in impairment of adhesion when more than 15 parts by mass.

1-5. Other Additives

To the adhesive resin composition in the present embodiment, it is possible to appropriately add additives such as antioxidant, copper inhibitor, antiblocking agent, colorant, thickener, cross-linking agent, crosslinking aid, antistatic agent, ultraviolet absorber, light stabilizer and hydrolysis inhibitor.

2. Adhesive Film

As shown in FIG. 1, an adhesive film 4 in the present embodiment has an adhesive layer 3 which contains the above-mentioned adhesive resin composition and is formed on a base film 1 by wet-coating. Note that, FIG. 1 shows the case where an anchor coat layer 2 is formed between the base film 1 and the adhesive layer 3 in order to enhance adhesion. That is, for example, the anchor coat layer 2 is formed, if necessary, on the base film 1 having a predetermined thickness and the above-mentioned adhesive resin composition is then formed into a coating material using toluene, methyl ethyl ketone or a mixture thereof as a solvent and is applied by wet-coating to form the adhesive layer 3, thereby forming the adhesive film 4 in the present embodiment.

2-1. Base Film

Examples of the base film used for the adhesive film in the present embodiment include a polyethylene terephthalate film, a polyethylene naphthalate film, a polyphenylene sulfide film, a polyimide film, a polyamide-imide film, a polyether ketone film, a liquid crystal polymer film, a polyvinyl chloride film and a polypropylene film. Adhesive strength of the base film can be enhanced by corona, plasma or UV ozone surface-treatment.

The thickness of the base film is preferably 10 to 100 μm. When less than 10 μm, the film does not have sufficient strength and may be torn during wet-coating. When the thickness of the base film is more than 100 μm, flexibility as a flat cable may be impaired.

2-2. Adhesive Layer

The coating material containing the above-mentioned adhesive resin composition is applied and then dried, thereby forming an adhesive layer of the adhesive resin composition on the base film. The thickness of the adhesive layer is preferably 10 to 100 μm. It may not be possible to obtain sufficient flame retardancy when less than 10 μm while flexibility may be impaired when more than 100 μm.

2-3. Anchor Coat Layer

In the present embodiment, an anchor coat layer may be further formed between the base film and the adhesive layer, if necessary. The anchor coat layer is required to have high adhesion to the base film. In many cases, the anchor coat layer is formed of the amorphous thermoplastic polyester-based resin (A) and the isocyanate compound (C) containing plural isocyanate groups. It is possible to use a polyester-based polyurethane resin other than the amorphous thermoplastic polyester-based resin (A).

To the anchor coat layer, it is possible to add various flame retardants, hydrolysis inhibitor, antioxidant, colorant, thickener, cross-linking agent, crosslinking aid, copper inhibitor, antistatic agent, ultraviolet absorber, light stabilizer, if necessary.

The thickness of the anchor coat layer is preferably 1 to 10 μm. A sufficient effect may not obtained when less than 1 μm while flame retardancy may not be sufficient when more than 10 μm.

3. Flat Cable

Figure 2:
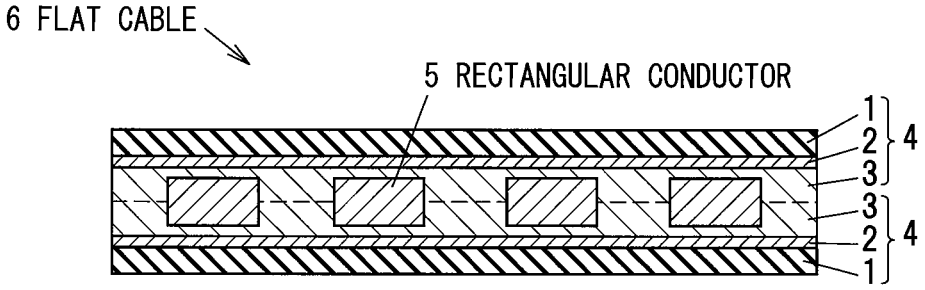
FIG. 2 is a schematic cross sectional view showing a flat cable in the embodiment of the invention.

As shown in FIG. 2, a flat cable 6 in the present embodiment has a pair of the adhesive films 4 arranged so that the respective adhesive layers 3 face each other and plural conductors 5 sandwiched between the pair of adhesive films 4 and arranged in parallel to each other, and is configured that the pair of adhesive films 4 are adhered to and integrated with the conductors 5 by adhesion between the respective adhesive layers 3 of the pair of adhesive films 4.

The conductors used in the present embodiment are, e.g., forty tin-plated rectangular conductors each having a width of 0.3 mm and a thickness of 35 μm which are arranged in parallel at intervals of 0.2 mm. In general, a rectangular conductor having a width of 0.3 to 2.0 mm and a thickness of 20 to 125 μm may be used as the conductor and the conductor may be a nickel-plated rectangular conductor, a gold-plated rectangular conductor and a copper rectangular conductor without plating besides the tin-plated rectangular conductor.

EXAMPLES

The adhesive resin composition, the adhesive film using the same and the flat cable of the invention will be described below more specifically in reference to Examples. It should be noted that the invention is not limited to the following Examples.

Example 1

A 12 μm-thick polyethylene terephthalate film (product name: Lumirror S10, manufactured by Toray Industries, Inc.) with a corona-treated surface was used as the base film. For the anchor coat layer, a coating material composed of 100 parts by mass of the amorphous thermoplastic polyester-based resin (A) (product name: Vylon 670, manufactured by Toyobo Co., Ltd., glass transition temperature: 7° C.), 10 parts by mass of the isocyanate compound (C) having plural isocyanate groups (product name: Coronate L, manufactured by Nippon Polyurethane Industry Co., Ltd.), 240 parts by mass of solvent (toluene) and 60 parts by mass of solvent (methyl ethyl ketone) was applied onto the corona-surface-treated polyethylene terephthalate film by a micro gravure coater and was dried, thereby forming a 1 μm-thick anchor coat layer.

For an adhesive layer of adhesive resin composition, a coating material containing an adhesive resin composition composed of 95 parts by mass of the amorphous thermoplastic polyester-based resin (A) (product name: Vylon 670, manufactured by Toyobo Co., Ltd., glass transition temperature: 7° C.), 5 parts by mass of the polyphenylene ether-based polymer (B) (product name: OPE (registered trademark) manufactured by Mitsubishi Gas Chemical Company, Inc.), 60 parts by mass of bromine compound as a flame retardant (product name: Saytex 8010 manufactured by Albemarle Corporation), 15 parts by mass of the isocyanate compound (C) as a curing agent (product name: Coronate HX, manufactured by Nippon Polyurethane Industry Co., Ltd.), 250 parts by mass of solvent (toluene, Special grade by Wako Pure Chemical Industries, Ltd.) and 50 parts by mass of solvent (methyl ethyl ketone, Special grade by Wako Pure Chemical Industries, Ltd.) was made, was applied onto the anchor coat layer by a slot die coater and was dried to form a 30 μm-thick adhesive layer, thereby making an adhesive film.

Next, forty tin-plated rectangular conductors each having a width of 0.3 mm and a thickness of 35 μm were arranged in parallel at intervals of 0.2 mm between a pair of adhesive films obtained as described above and were laminated, thereby making a flat cable.

Examples 2 to 11

Adhesive films and flat cables were made in the same manner as Example 1 except that the compositions of the coating material containing the adhesive resin composition used for forming the adhesive layer were changed to those shown in Table 1.

Comparative Examples 1 to 3

Adhesive films and flat cables were made in the same manner as Example 1 except that the compositions of the adhesive resin composition coating material used for forming the adhesive layer were changed to those shown in Table 2.

Evaluation of Characteristics

Heat resistance of the adhesive resin compositions and flame retardancy and adhesion of the flat cables in Examples and Comparative Examples were evaluated as follows. Tables 1 and 2 show the results.

1. Heat Resistance

Heat resistance of the adhesive resin composition was evaluated as follows. That is, a coating material containing the adhesive resin composition having the composition shown in Table 1 was applied to a flat and smooth copper plate having a width of 50 mm×50 mm and a thickness of 1 mm and a solvent was then removed, thereby forming a 30 μm-thick resin composition layer. Using a 50 mm-long cylindrical copper bar having a diameter of 3 mm with a 3 mm-long cylindrical tip portion having a diameter of 1 mm, load was applied on the resin composition layer so that 1 MPa of pressure is applied and the plate was kept in a constant-temperature oven at 80° C. for 3 hours in a state that a current tester was inserted between the copper plate and the copper bar. No electrical conduction within 3 hours was regarded as passed the heat resistant test.

2. Flame Retardancy

The UL VW-1 test in accordance with UL 758 AWM was conducted on the flat cable manufactured as described above and the flame retardancy of the flat cable was evaluated. The result was judged as ◎ (excellent) when 5 out of 5 test pieces passed the test, ○ (good) when 3 to 4 test pieces passed the test and X (bad) when 0 to 2 test pieces passed the test.

3. Adhesion

For adhesion of flat cable, a 180° peeling test of a tin-plated rectangular conductor (at a tension rate: 50 cm/min) was conducted on a terminal portion of the flat cable manufactured as described above, and peel strength (adhesion) was evaluated. The peel strength of not less than 0.7 kN/m was judged as ◎, not less than 0.5 kN/m and less than 0.7 kN/m was judges as ○ and less than 0.5 kN/m was judges as X.

Note that, the flame retardancy and the adhesion (peel strength) are regarded as satisfactory unless it is X.

As understood from Tables 1 and 2, the adhesive resin compositions and the flat cables obtained in Examples 1 to 11 were satisfactory in all characteristics. In other words, all test pieces passed the heat resistant test and were evaluated as ◎ or ○ in flame retardancy and adhesion.

On the other hand, the adhesive resin composition and the flat cable obtained in Comparative Example 1 not containing the polyphenylene ether-based polymer (B) did not pass the heat resistant test. In addition, the added amount of the flame retardant was more than 200 parts by mass, which results in that the test pieces passed the flame retardant test but had insufficient adhesion.

Meanwhile, the adhesive resin composition and the flat cable obtained in Comparative Example 2 not containing the polyphenylene ether-based polymer (B) did not pass the heat resistant test. The added amount of the flame retardant was as insufficient as 50 parts by mass, which results in that the test pieces did not pass the flame retardant test.

Furthermore, the adhesive resin composition and the flat cable obtained in Comparative Example 3 not containing the amorphous thermoplastic polyester-based resin (A) had insufficient adhesion.

TABLE 1

| Items | | | | | | Composition | | | | | |
|---|---|---|---|---|---|---|---|---|---|---|---|
| | | | | | | Ex1 | Ex2 | Ex3 | Ex4 | Ex5 | Ex6 |
| Proportion of Coating material (parts by mass) | Adhesive resin composition | Resin | Amorphous thermoplastic polyester-based resin (A) | Vylon 670, Toyobo | Tg: 7° C. | 95 | | 85 | | 75 | |
| | | | | Vylon GK330 | Tg: 16° C. | | 90 | | 80 | | 70 |
| | | | | Elitel UE3500 | Tg: 35° C. | | | | | | |
| | | | Polyphenylene ether-based polymer (B) | OPE, Mitsubishi Gas Chem. | Hydroxyl groups at both terminals | 5 | 10 | 15 | 20 | 25 | 30 |
| | | Flame retardant | Bromine compound | Saytex 8010, Albemarle | — | 60 | 80 | | | | 100 |
| | | | | Saytex BT-93, Albemarle | — | | | 100 | 120 | | |
| | | | Metal phosphate | Exolit OP935, Clariant | — | | | | | 130 | |
| | | | Phosphate | FP2100J, Adeka | — | | | | | | |
| | | | 1,3,5-triazine derivative | MC-5S, Sakai Chemical Industry | — | | | | | | |
| | | | Calcium borate | UBP, Kinseimatec | — | | | | | | |
| | | | Zinc stannate | Alcanex ZS, Mizusawa Chem. | — | | | | | | |
| | | | Magnesium hydroxide | Kisuma 5L, Kyowa Chem. | — | | | | | | |
| | | | Aluminum hydroxide | Higilite H-42S, Showa Denko | — | | | | | | |
| | | Curing agent | Isocyanate compound (C) | Coronate HX | — | 15 | | | | | |
| | | | | Coronate L | — | | 10 | | | | |
| | | | | Millionate MR-200 | — | | | 1 | 3 | 5 | |
| | Solvent | | Toluene | Special grade, Wako Pure Chem. | — | 250 | 250 | 250 | 250 | 250 | 250 |
| | | | Methyl ethyl ketone | Special grade, Wako Pure Chem. | — | 50 | 50 | 50 | 50 | 50 | 50 |
| Characteristics Evaluation | | | Flame retardancy | UL758 Vertical flame test | | ○ | ◎ | ◎ | ◎ | ◎ | ◎ |
| | | | Adhesion | 180° peeling test: Strength ≥ 0.5 kN/m | | ◎ | ◎ | ◎ | ○ | ○ | ○ |
| | | | Heat resistance | No conduction between Plate and Bar after 3 hours at 80° C. | | Pass | Pass | Pass | Pass | Pass | Pass |

| Items | | | | | | Composition | | | | |
|---|---|---|---|---|---|---|---|---|---|---|
| | | | | | | Ex7 | Ex8 | Ex9 | Ex10 | Ex11 |
| Proportion of Coating material (parts by mass) | Adhesive resin composition | Resin | Amorphous thermoplastic polyester-based resin (A) | Vylon 670, Toyobo | Tg: 7° C. | 65 | | 80 | | 65 |
| | | | | Vylon GK330 | Tg: 16° C. | | 60 | | 70 | |
| | | | | Elitel UE3500 | Tg: 35° C. | | | 10 | 10 | 5 |
| | | | Polyphenylene ether-based polymer (B) | OPE, Mitsubishi Gas Chem. | Hydroxyl groups at both terminals | 35 | 40 | 10 | 20 | 30 |
| | | Flame retardant | Bromine compound | Saytex 8010, Albemarle | — | | | | | |
| | | | | Saytex BT-93, Albemarle | — | | | | | |
| | | | Metal phosphate | Exolit OP935, Clariant | — | | 120 | 130 | 135 | 140 |
| | | | Phosphate | FP2100J, Adeka | — | 150 | | | | |
| | | | 1,3,5-triazine derivative | MC-5S, Sakai Chemical Industry | — | | | | | |
| | | | Calcium borate | UBP, Kinseimatec | — | | 40 | | | |
| | | | Zinc stannate | Alcanex ZS, Mizusawa Chem. | — | | | 50 | | |
| | | | Magnesium hydroxide | Kisuma 5L, Kyowa Chem. | — | | | | 55 | |

TABLE 1-continued

| | | | | | | | | | |
|---|---|---|---|---|---|---|---|---|---|
| | | Aluminum hydroxide | Higilite H-42S, Showa Denko | — | | | | | 60 |
| | Curing agent | Isocyanate compound (C) | Coronate HX | — | 5 | 5 | | | |
| | | | Coronate L | — | | | | | |
| | | | Millionate MR-200 | — | | | 3 | 2 | 1 |
| Solvent | | Toluene | Special grade, Wako Pure Chem. | — | 250 | 250 | 250 | 250 | 250 |
| | | Methyl ethyl ketone | Special grade, Wako Pure Chem. | — | 50 | 50 | 50 | 50 | 50 |
| Characteristics Evaluation | | Flame retardancy | UL758 Vertical flame test | | ◎ | ◎ | ◎ | ◎ | ◎ |
| | | Adhesion | 180° peeling test: Strength ≥ 0.5 kN/m | | ○ | ○ | ○ | ○ | ○ |
| | | Heat resistance | No conduction between Plate and Bar after 3 hours at 80° C. | | Pass | Pass | Pass | Pass | Pass |

Ex: Example

TABLE 2

| | | | | | | Composition | | |
|---|---|---|---|---|---|---|---|---|
| | | | | | | Comparative Example 1 | Comparative Example 2 | Comparative Example 3 |
| Proportion of Coating material (parts by mass) | Adhesive resin composition | Resin | Amorphous thermoplastic polyester-based resin (A) | Vylon 670, Toyobo | Tg: 7° C. | 100 | 100 | |
| | | | Polyphenylene ether-based polymer (B) | OPE, Mitsubishi Gas Chem. | Hydroxyl groups at both terminals | | | 100 |
| | | Flame retardant | Bromine compound | Saytex 8010, Albemarle | — | 210 | | |
| | | | | Saytex BT-93, Albemarle | — | | 50 | |
| | | | Metal phosphate | Exolit OP935, Clariant | — | | | 120 |
| | | Curing agent | Isocyanate compound (C) | Coronate HX | — | 0.5 | 20 | 5 |
| | Solvent | | Toluene | Special grade, Wako Pure Chem. | — | 250 | 250 | 250 |
| | | | Methyl ethyl ketone | Special grade, Wako Pure Chem. | — | 50 | 50 | 50 |
| Characteristics Evaluation | | | Flame retardancy | UL758 Vertical flame test | | ◎ | X | ◎ |
| | | | Adhesion | 180° peeling test: Strength ≥ 0.5 kN/m | | X | ○ | X |
| | | | Heat resistance | No conduction between Plate and Bar after 3 hours at 80° C. | | Fail | Fail | Pass |

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. An adhesive resin composition, comprising:

60 to 95 parts by mass of amorphous thermoplastic polyester-based resin (A);

5 to 40 parts by mass of polyphenylene ether-based polymer (B) comprising a hydroxyl group and a repeating unit of 2, 6-dimethylphenylene ether in a molecule thereof; and 60 to 200 parts by mass of a flame retardant per total 100 parts by mass of the amorphous thermoplastic polyester based resin (A) and the polyphenylene ether-based polymer (B), wherein the amorphous thermoplastic polyester based resin (A) has a glass transition temperature of −20 to 40° C.

2. The adhesive resin composition according to claim 1, further comprising 1 to 15 parts by mass of an isocyanate compound (C) per total 100 parts by mass of the amorphous thermoplastic polyester based resin (A) and the polyphenylene ether-based polymer (B), wherein the isocyanate compound (C) comprises a plurality of isocyanate groups in a molecular structure thereof.

3. The adhesive resin composition according to claim 1, wherein the polyphenylene ether-based polymer (B) has an average molecular weight of 1000 to 3000 in terms of styrene.

4. The adhesive resin composition according to claim 1, wherein the flame retardant comprises at least one of bromine compounds, phosphorus compounds, nitrogen compounds and metal compounds.

5. An adhesive film, comprising:

a base film; and an adhesive layer that comprises the adhesive resin composition according to claim 1 and is formed on the base film by wet-coating.

6. A flat cable, comprising:

a pair of the adhesive films according to claim 5 arranged so that the respective adhesive layers face each other; and a plurality of conductors sandwiched between the pair of the adhesive films and arranged in parallel to each other, wherein the pair of the adhesive films are adhered to and integrated with the conductors by adhesion between the respective adhesive layers of the pair of the adhesive films.

7. The adhesive resin composition according to claim 1, wherein the polyphenylene ether-based polymer (B) has hydroxyl groups at both terminals.

8. The adhesive resin composition according to claim 1, wherein the polyphenylene ether-based polymer (B) has a glass transition temperature of more than 100° C.

9. The adhesive resin composition according to claim 1, wherein the amorphous thermoplastic polyester-based resin (A) and the polyphenylene ether-based polymer (B) are dissolved in a same solvent.

10. The adhesive resin composition according to claim 1, wherein the amorphous thermoplastic polyester-based resin (A) and the polyphenylene ether-based polymer (B) are dissolved in at least one of toluene and methyl ethyl ketone.

* * * * *